US005651615A

United States Patent [19]

Hurier

[11] Patent Number: 5,651,615

[45] Date of Patent: Jul. 29, 1997

[54] SECURITY LABEL

[75] Inventor: François Hurier, Quétigny, France

[73] Assignee: Plasto, SA, Chenove, France

[21] Appl. No.: 420,401

[22] Filed: Apr. 12, 1995

[51] Int. Cl.[6] ..... B42D 15/00

[52] U.S. Cl. ..... 283/92; 283/91; 283/72

[58] Field of Search ..... 283/72, 74, 86, 283/89, 91, 92

[56] References Cited

U.S. PATENT DOCUMENTS 5,388,862 2/1995 Edwards ..... 283/91 X 5,449,200 9/1995 Andric et al. ..... 283/91 X 5,522,623 6/1996 Soules et al. ..... 283/91

*Primary Examiner*—Willmon Fridie, Jr.

*Attorney, Agent, or Firm*—Hoffmann & Baron

[57] ABSTRACT

A security device for identifying products includes a printing medium in which luminescent agents are dispersed and having at least one opaque part disposed on at least one luminescent part of the medium. The opaque part is the same color as the luminescent part and has at least one contour of a different color. When illuminated by predetermined radiation in the non-visible spectrum, the device shows an image different than that observed in ordinary light.

12 Claims, 2 Drawing Sheets

SECURITY LABEL

BACKGROUND OF THE INVENTION

1. Field of the Invention

The present invention concerns a security device for identifying products and in particular a device comprising a security label designed to be applied to products or articles such as automobile spare parts to identify their source.

2. Description of the Prior Art

Most articles sold and components used by industry are identified by self-adhesive labels applied directly to the article or to its packaging. The label gives the source of the article and the name of the manufacturer and/or the reseller in addition to information on the nature and specifications of the article.

However, in some sectors of industry such as automobiles and perfumes, pirated articles often have labels applied to them which are in all respects identical to those carried by the original article: pirated articles, the quality of which may be very much inferior to that of authentic items, can therefore be mistaken for the items sold by the genuine manufacturer. At this time the financial losses arising from pirating of automobile body parts on the French market (for example) are very considerable.

In the field of automobile spare parts in particular, the dubious quality of some pirated articles, such as brake pads, for example, can put the user in danger without them realizing it. Some non-genuine brake pads can wear out in a very short time, and this can cause serious and even fatal accidents. Permanent security marking is one way to restrict pirating.

One solution previously put forward is to use self-adhesive labels which carry symbols or text printed in a special luminescent ink so that the text and/or symbols can be read only under ultra-violet light. One such label uses the principle of a security document described in French patent application FR-A-2 552 023. A rectangle is printed in fluorescent ink visible only in ultra-violet light on a medium containing no fluorescent agents, with the result that the document cannot be photocopied.

An object of the present invention is to propose a secure product identification device which is simple to manufacture.

SUMMARY OF THE INVENTION

The present invention consists in a security device for identifying products including a printing medium in which luminescent agents are dispersed and having at least one opaque part disposed on at least one luminescent part of the medium, said opaque part being the same color as said luminescent part and having at least one contour of a different color, the device showing when illuminated by predetermined radiation in the non-visible spectrum an image different than that observed in ordinary light. By "ordinary light" is meant daylight or artificial light produced by ordinary incandescent or fluorescent lamps, for example.

The present invention also consists in a security label printed with a colored ink on a paper medium containing luminescent agents and having at least one visible part printed with an opaque ink the same color as said paper medium, wherein said opaque ink is visible only in ultra-violet light and said part printed with said opaque ink is delimited by at least one contour printed with an ink which is a different color to said opaque ink.

The device and labels of the present invention have the advantage that they cannot be identified in ordinary light, i.e. in natural light or artificial light, and are difficult to detect even by experienced persons.

Other features and advantages of the invention will emerge more clearly from the following description of various embodiments of the invention and from the appended drawings.

DETAILED DESCRIPTION OF THE PREFERRED EMBODIMENTS

Figure 1:
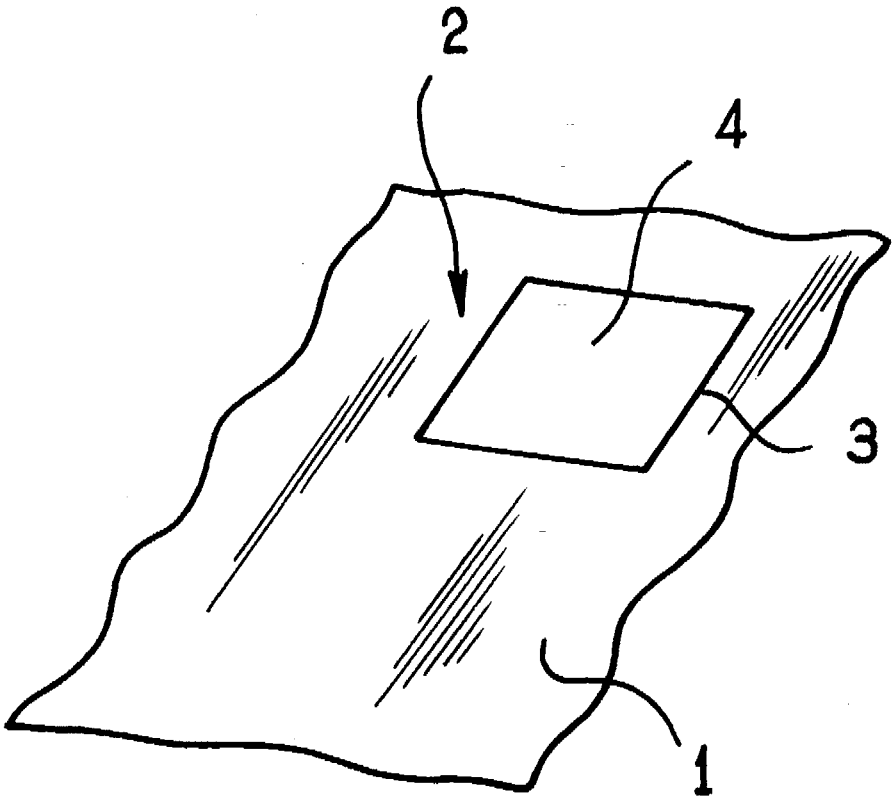
FIG. 1 is a diagrammatic perspective view of a device of the invention.

The device of the invention shown in FIG. 1 includes a printing medium 1 in which are dispersed luminescent agents, preferably covering all of the surface of said medium which is white in color, for example. At least one opaque part 2 the same color as the medium 1 (white in this example) is disposed on said medium and delimited by a contour 3 of a different color (for example black). The interior 4 of the opaque part 2 must not be distinguishable from the medium 1 in ordinary light but only identifiable in a particular kind of light, for example ultra-violet light.

If the opaque part is to be printed, the printing can be positive or negative, as described with reference to the embodiments shown in FIGS. 2 through 4.

A label of the invention is printed on a medium containing luminescent agents; this medium is preferably a white vellum, coated, etc type paper which ordinarily includes optical whitening agents to whiten the paper; other types of medium can be used instead, for example films of synthetic materials such as polyester or polypropylene, provided that these materials contain luminescent agents. This medium is printed with an opaque white ink containing no luminescent agents and the usual kind of information carried by a label is printed using one or more colored inks. The printing with the white and colored ink is carried out in such a way that the areas printed with the opaque white ink that remain visible are delimited by areas printed with the colored ink: in this way there is no place at which there can be seen any slight contrast between the white paper and the white ink which might be detectable in ordinary natural or artificial light. Only ultra-violet light can show a clear difference in luminescence between the areas printed with the white ink, which will appear dark, and the white paper, which is luminescent.

The labels printed in this way authenticate the articles to which they are applied by virtue of the presence of distinctive symbols which cannot be seen in ordinary lighting.

These labels can be attached by means of a tie, but are preferably self-adhesive or pasted on so that they cannot be removed from the article intact.

Figure 2:
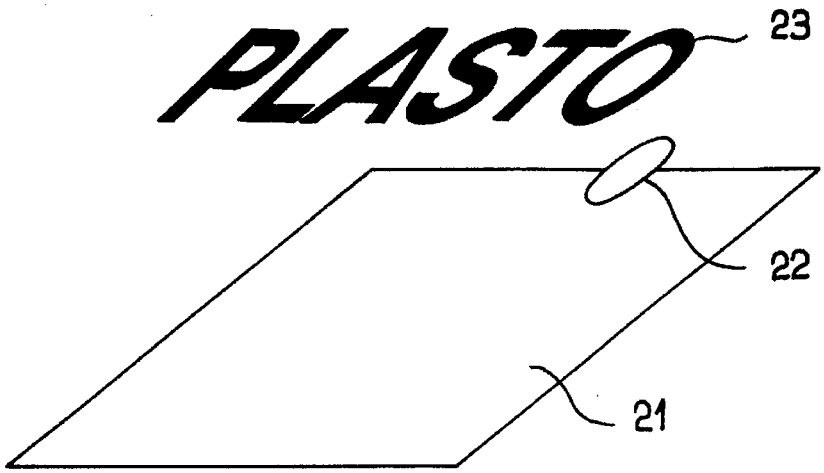
FIG. 2 is an exploded perspective view of a positive printed label constituting a first embodiment of the invention.

In the embodiment of FIG. 2 the label is printed on a self-adhesive medium 21 with a backing sheet. This medium is white paper and contains luminescent agents intended to enhance the whiteness in ordinary lighting. This medium is positive printed with letters and symbols 23 forming the logotype of a company, for example. Some closed parts of the letters, for example the center of the letter O (22) are printed with an opaque white ink: in ordinary light the name appears in the usual way. In ultra-violet light the name appears differently because the letter O looks like a solid disk rather than the usual annular shape.

Figure 3:
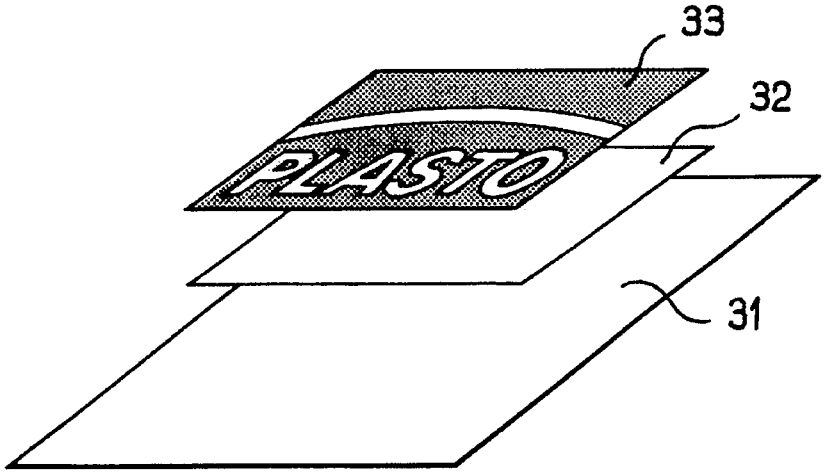
FIG. 3 is an exploded perspective view of a negative printed label constituting a second embodiment of the invention.

In the FIG. 3 embodiment the label is made from a medium 31 consisting of white vellum paper containing luminescent agents. The label is self-adhesive with a backing sheet. A rectangle 32 is printed on part of the label using opaque white ink. Its dimensions are a×b. When this ink has dried, a colored ink is used to negative print a second rectangle 33 including the logotype of the company; this second rectangle 33 also has dimensions a×b and is superimposed exactly on the white ink rectangle 32. In this way the characters of the logotype are printed in the white ink and, unlike conventional negative printing which would show these luminescent characters in ultra-violet light, the label of the invention does not show these characters in ultra-violet light.

Figure 4:
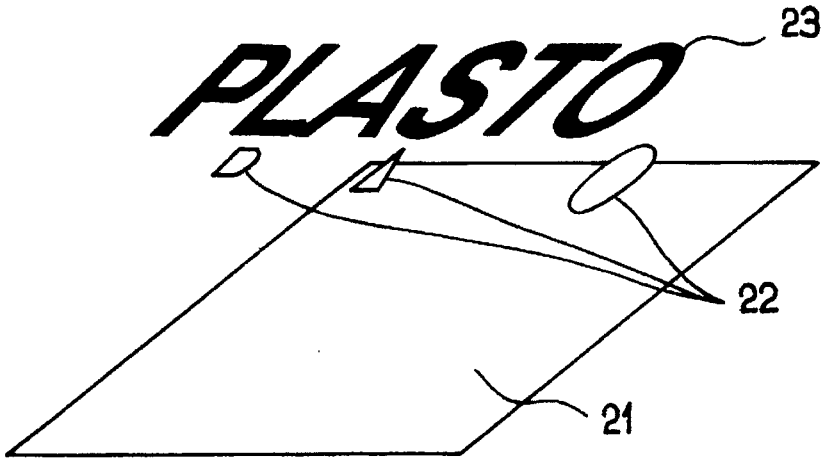
FIG. 4 is an exploded perspective view of a positive printed label constituting a third embodiment of the invention.

The embodiment of FIG. 4 uses the same principle as that of FIG. 1, but the closed parts of the letters P, A and O are printed in the white ink.

These three examples are given to illustrate the invention, but in no way limit its scope; there are unlimited combinations of printing with colored ink and opaque white ink to obtain security type printing. The examples refer to the use of a white paper which has the advantage of being manufactured with luminescent agents in it: other media can be used instead, for example films of synthetic material such as polyester or polypropylene, specially impregnated or coated with luminescent agents; in one variant of the invention the label medium can be a light color other than white and in this case the opaque ink is exactly the same color as the medium in ordinary light. Using a label of the invention, it is a quick and simple matter to verify the authenticity of an object by checking that the label is correct, the label having the usual appearance in ordinary light but a special appearance in ultra-violet light.

Labels of this kind incorporating security printing are particularly intended for identifying and authenticating objects or articles likely to be pirated, such as automobile spare parts or high-cost luxury goods.

Another application of the device of the invention is to authenticating documents containing important information, such documents including parts printed in accordance with the invention; these parts can be printed directly on the document or on a self-adhesive label as described hereinabove.

There is claimed:

1. Security device for identifying products including a printing medium in which luminescent agents are dispersed and having at least one opaque part printed on at least one luminescent part of said medium, said opaque part being the same color as said luminescent part and said device having at least one contour of a different color printed thereon, said device showing a first image when illuminated by predetermined radiation thereby activating the luminescence of said support, said first image being different from a second image observed in ordinary light.

2. Device according to claim 1 wherein said predetermined radiation is ultra-violet light.

3. Device according to claim 1 wherein said medium is white paper incorporating optical whitening agents and said opaque part is printed with opaque white ink.

4. Device according to claim 3 wherein at least part of said opaque part is covered with ink of a color different than the white ink used to render said opaque part opaque.

5. Device according to claim 1 wherein said medium is printed with said opaque white ink and a colored ink is negative printed over at least part of said opaque white ink printing.

6. Security label printed with a colored ink on a paper medium containing luminescent agents and having at least one visible part printed with an opaque ink the same color as said paper medium, wherein said opaque ink is visible only in ultra-violet light and said part printed with said opaque ink is delimited by at least one contour printed with an ink which is a different color to said opaque ink.

7. Label according to claim 6 wherein said paper medium is white paper and said opaque ink is white ink applied to a plurality of visible areas each delimited by a contour printed with a colored ink.

8. Label according to claim 6 wherein the colored ink printing covers part of the opaque ink printing.

9. Label according to claim 8 wherein said colored ink printing is negative printing covering a surface printed with said opaque ink.

10. Label according to claim 6 which is self-adhesive on one side.

11. A security label for identifying products comprising:

a printing medium having dispensed thereon a luminescent part, said printing medium further including at least one opaque part dispersed on at least a portion of said luminescent part of said priming medium, said opaque part and said luminescent part being the same color, said medium further including a contour of a different color delimiting at least a portion of the opaque part from the luminescent part, wherein the opaque part is indistinguishable from the luminescent part in ordinary light and distinguishable in light having a predetermined wavelength different from ordinary light.

12. A security label according to claim 11, wherein the light having a predetermined wavelength is ultra-violet light.

* * * * *